US005233722A

United States Patent [19]

McKnight et al.

[11] Patent Number: 5,233,722

[45] Date of Patent: Aug. 10, 1993

[54] CLEANER UPPER PORTION WITH TOOL STORAGE AND DOOR

[75] Inventors: Darwin T. McKnight, Louisville; Gerald L. Melegari, North Canton, both of Ohio

[73] Assignee: The Hoover Company, North Canton, Ohio

[21] Appl. No.: 803,579

[22] Filed: Dec. 9, 1991

[51] Int. Cl.[5] ..... A47L 9/00

[52] U.S. Cl. ..... 15/323; 15/351; 220/338

[58] Field of Search ..... 15/323, 350, 351; 220/4.23, 338

[56] References Cited

U.S. PATENT DOCUMENTS

| | | | |
|---|---|---|---|
| 839,297 | 12/1906 | Kennedy et al. . | |
| 1,043,683 | 11/1912 | Fieser . | |
| 3,023,923 | 3/1962 | Geib et al. | 220/338 |
| 3,484,895 | 12/1969 | Mock | 16/178 |
| 3,633,244 | 1/1972 | Grossman | 16/178 |
| 4,315,345 | 2/1982 | Schijf | 16/267 |
| 4,554,700 | 11/1985 | Lyman | 15/323 |
| 5,014,388 | 5/1991 | Schiazza et al. | 15/351 X |
| 5,048,715 | 9/1991 | Wolff | 220/338 X |
| 5,078,297 | 1/1992 | Howard et al. | 220/338 X |

FOREIGN PATENT DOCUMENTS 1005527 9/1965 United Kingdom .

OTHER PUBLICATIONS

Panasonic Vacuum Cleaner Model MC-E41.
National Vacuum Cleaner Model MCA-33ET.

*Primary Examiner*—Chris K. Moore

[57] ABSTRACT

An upright vacuum cleaner having an upper, hardened housing portion includes a tool containing tool storage well. A tool door is hinged to the housing to cover the well and includes a "breakaway" or hingedly detachable feature to limit damage to it or its associated structure from improper operation.

1 Claim, 6 Drawing Sheets

CLEANER UPPER PORTION WITH TOOL STORAGE AND DOOR

BACKGROUND OF THE INVENTION

1. Field of the Invention

This invention relates to vacuum cleaners and, more particularly relates to a tool storage and door arrangement utilized with an upright cleaner.

2. Summary of the prior

The use of internal tool storage with vacuum cleaners including upright cleaners has already been developed, as shown, e.g., in U.S. patent application Ser. No. 07/632,917, filed 24 December 1990 and owned by a common assignee. However, the storage arrangement shown in that application was designed for use with a hard bag cleaner so that space constrictions as well as accessibility required it disposition at or near the top of the hard bag and, thus, medial placement of the tool storage arrangement which might provide enlarged storage capability over that shown in the cited application was not contemplated. This storage position could, of course, be obtained in a hard bag cleaner with some additional dirt capacity penalty but, moreover, could very advantageously be provided in a cleaner having an upper portion hard housing not utilized as a hard bag cleaner upper portion.

The use of a covering door for this storage arrangement is also apparent since the cited application also shows as old closable, swinging tool doors utilized to cover their tool storage arrangements. Several of these doors include positive stops and all include non detachable hinges but unless these positive stops or hinges are structurally very strong there is a possibility of inadvertent breaking of a hinge or a stop by the operator of the upright cleaner or even the breaking of the door, itself. Thus a door, hinge and stop which were not subjected to such undue operator strain would also be desirable.

Accordingly, it is an object of this invention to provide a tool storage and tool door arrangement medially of an upright cleaner upper portion hard housing.

It is an additional object of the invention to provide a hinged tool door in an upright cleaner having a "break-away" or detachable feature for the door and its associated structure.

It is a still further object of the invention to provide a cleaner tool door stop and/or hinge not easily subject to breakage by inadvertent overstressing.

It is an even further object of the invention to provide a cleaner tool door stop which can be overridden by additional forced swinging of the tool door beyond the normal stop position.

It is an additional object of the invention to provide an overridable tool door stop and hinge so that the door may be easily released from its cleaner.

It is a final object of the invention to provide an improved tool door arrangement utilizable with a hard housing forming the upper portion of an upright cleaner.

SUMMARY OF THE INVENTION

An upright cleaner is provided having an upper portion pivotally mounted to a floor engaging nozzle for the upright cleaner. The upper portion includes a hard housing portion within which is disposed a tool storage arrangement. The tool storage containing volume is located generally medially of the hard housing so as to, potentially, permit the use of an enlarged volume for tool storage over that usually afforded by upper tool storage near the top of the hard housing, e.g., a hard bag housing. A tool door is hinged to the hard housing near its bottom with the tool door large enough to cover the tool storage arrangement. It latches at its top to an outwardly extending center post fixed with the hard housing over which spaced inwardly extending paired latches fixed to the door telescope. The door hinge is composed of a pair of spaced horizontally extending pivot pins formed integrally with the bottom of the door which engage in a pair of open U shaped portions formed slightly below the bottom of the tool storage volume in the hard housing. The tool door pivot pins lodge in open bores formed in each of the opening U shaped portions at their outer terminations. The remainder of each of the outwardly opening U shaped portions' slots being narrowed sufficiently to require a slight amount of force to push the pivot pins inwardly of the hard housing so that they tend to lodge in the bores of the U shaped portion portions. Disposed medially between the U shaped portions is mounted, fixed to the hard housing a cammable stop latch having a downwardly engageable hook portion which is abuttingly engaged by the tool door at its bottom as it swings downwardly open. This latch then provides a stop for the door to halt its opening movement with the tool door substantially parallel to the horizontal. However, in the event that the operator forces the door beyond this point, the bottom of the door cams the stop downwardly, permitting the door to "pop" past the stop latch so that it may swing further downwardly and, essentially, swing out of its U shaped mountings to be substantially automatically removed from its hinged engagement. This provides a break-away feature for the door. The tool door may be easily remounted by inserting the pivot points in their U shaped mountings at a below horizontal angling of the door, coupled with an upward swinging of the door to engage the bottom of the door with the nose of the stop latch to cam it again but this time upwardly to a non interfering position so that the tool door may be swung past it and closed.

BRIEF DESCRIPTION OF THE DRAWINGS

Reference may be had to the accompanying drawings for a better understanding of the invention, both as to its organization and function, with the illustration showing a preferred embodiment, but being only exemplary, and in which.

DETAILED DESCRIPTION OF DRAWINGS

Figure 1:
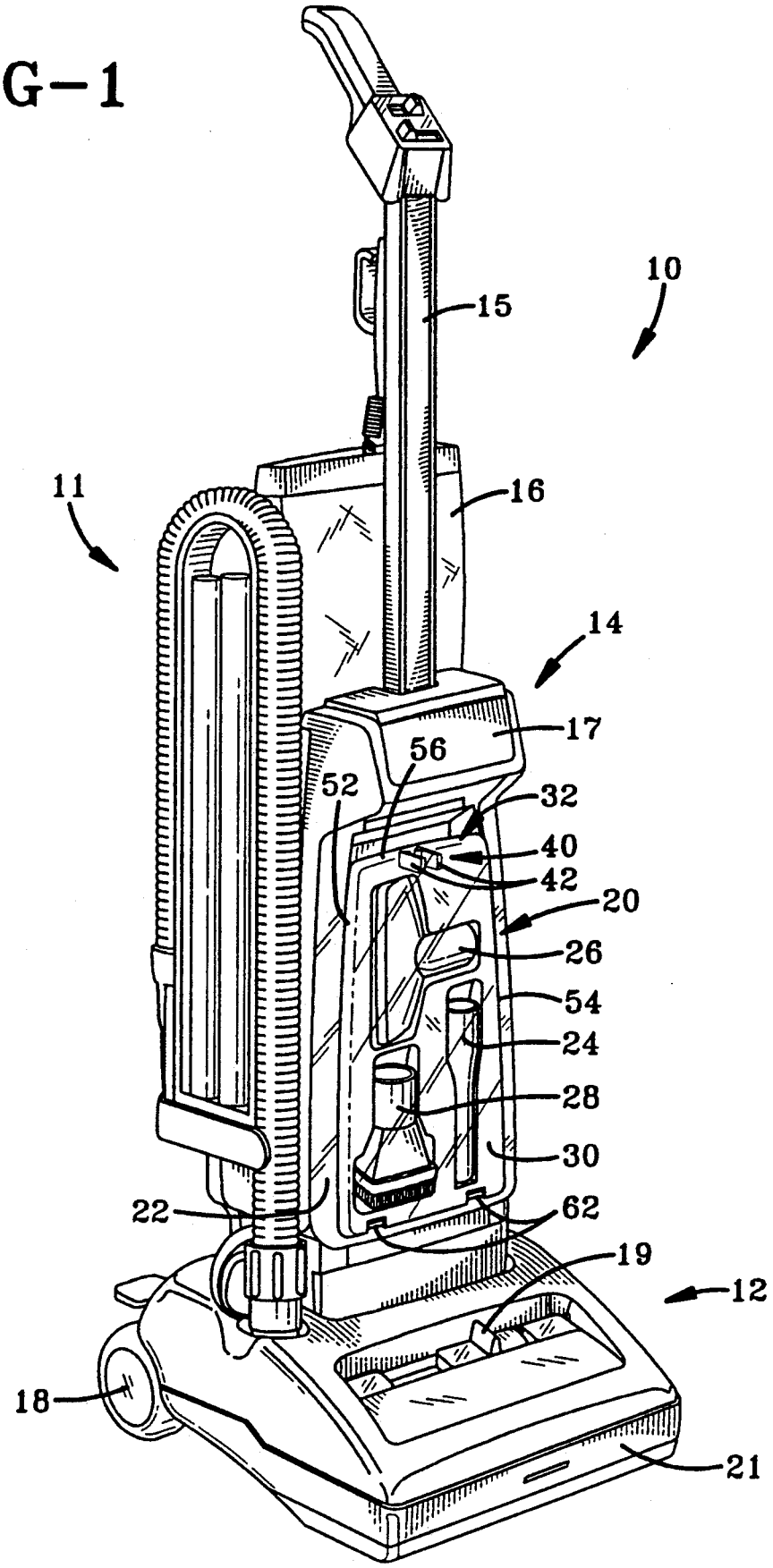
FIG. 1 is a left front perspective view of an upright cleaner incorporating the invention.
Figure 2:
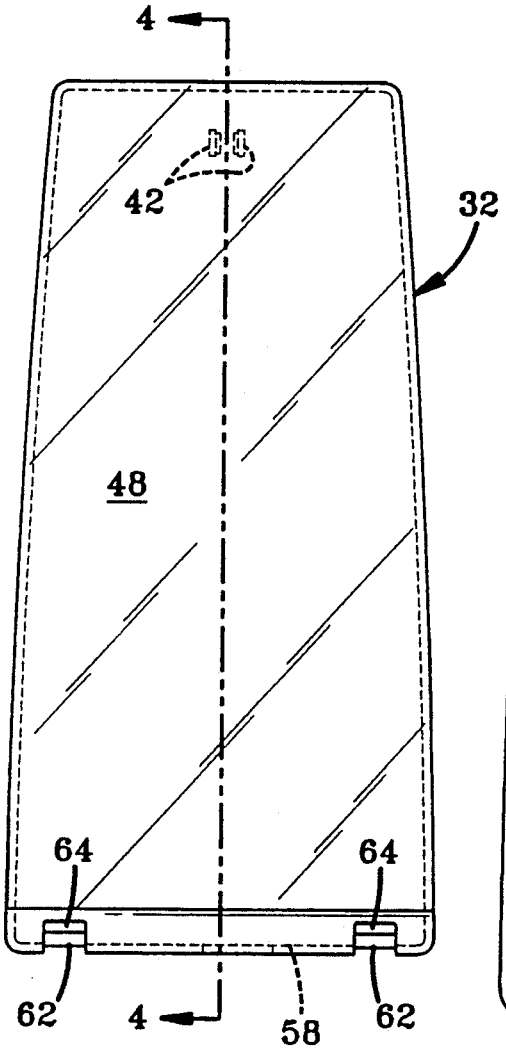
FIG. 2 is a front elevational view of the tool door.
Figure 3:
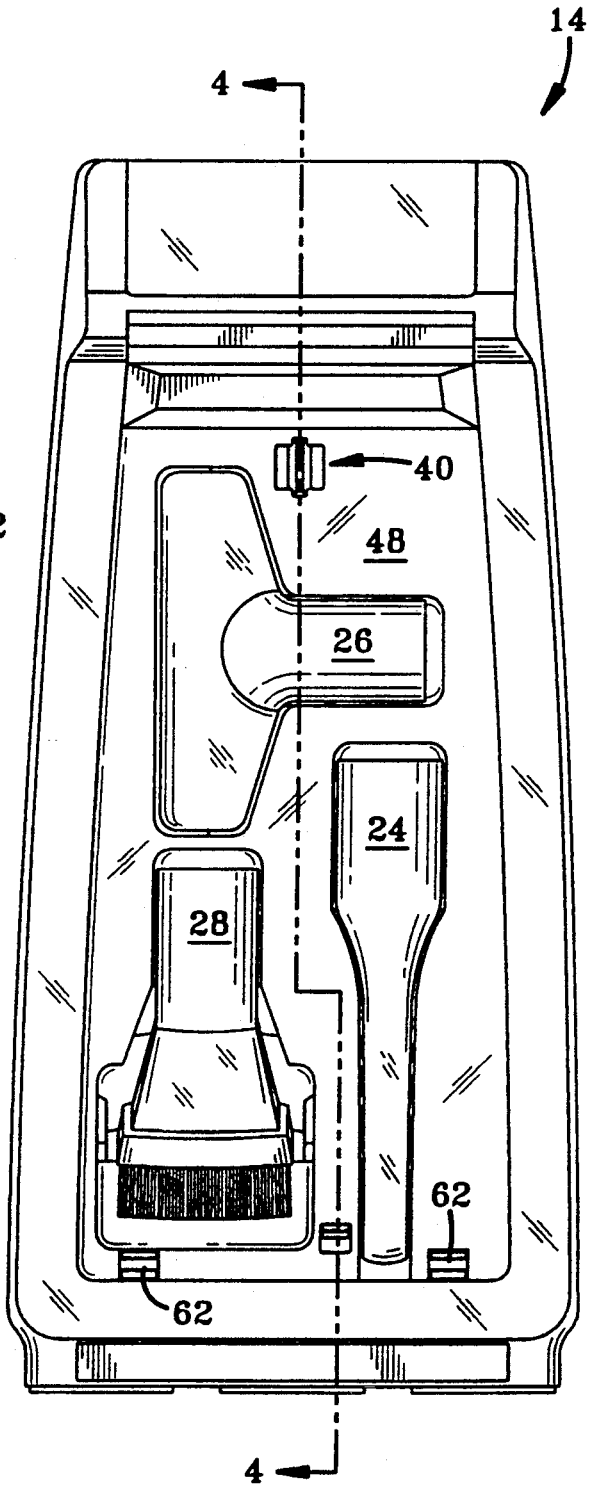
FIG. 3 is a front elevational view of the hard housing portion and mounted tool door.

There is shown in FIG. 1, an upright cleaner 10 having a mounted hose and tool rack 11 and a floor engaging nozzle 12 pivoted to a hard housing upper portion 14 surmounted by a handle 15. A cloth bag 16 which houses the dirt collecting bag (not shown) is disposed behind the hard housing upper portion 14 to receive the discharge of dirty air from the floor engaging nozzle 12. A handhold 17 for transportation of the cleaner 10 is provided in the upper reaches of the hard housing upper portion 14. Wheels 18 (only one shown) permit movement of the floor engaging nozzle 12 over floors to provide for this cleaner's cleaning function. A manually actuated height elevation knob 19 is movably mounted on the front of the floor engaging nozzle 12 and a furniture guard 21 surrounds this same nozzle.

A tool storage arrangement 20 is disposed in a front 22 of the hard housing and includes a crevice tool 24, a floor nozzle 26 and a wall and floor brush 28 mounted in a well 30 formed in the hard bag upper portion 14. A tool door 32 covers the well 30 and may, ideally, be made of smoked transparent plastic to permit user viewing of the tools from the front of the upright cleaner.

Figure 4:
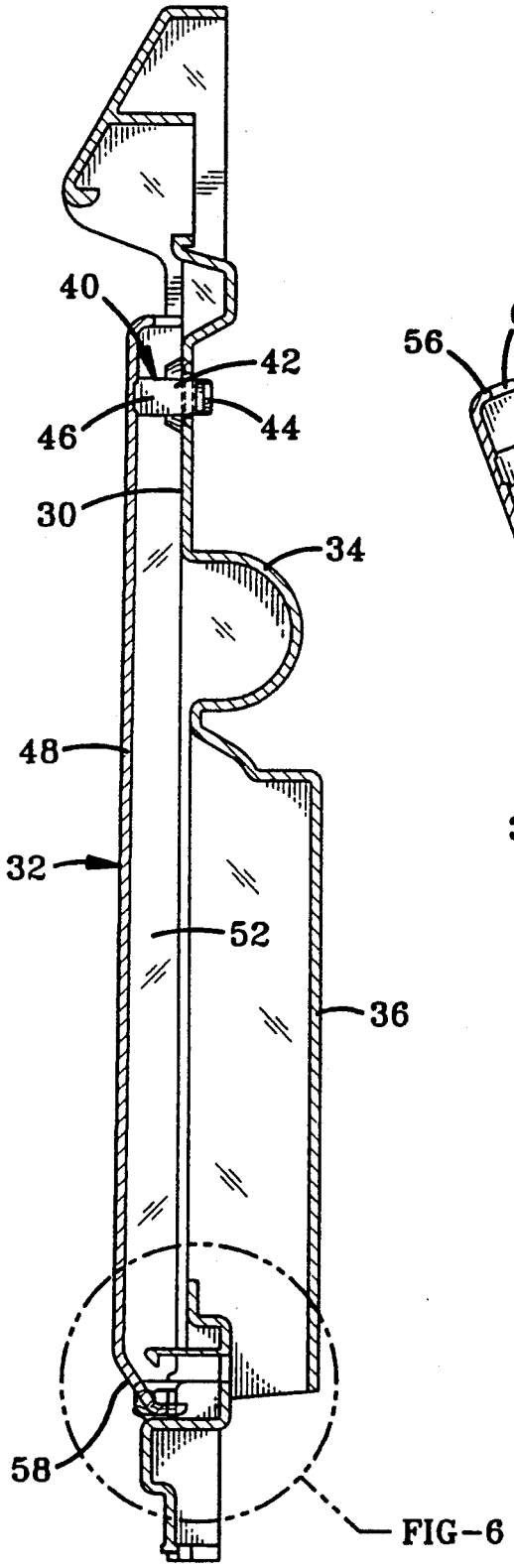
FIG. 4 is a cross sectional view of the closed tool door and hard housing as generally viewed when taken generally on line 4—4 in FIGS. 2 and 3.
Figure 5:
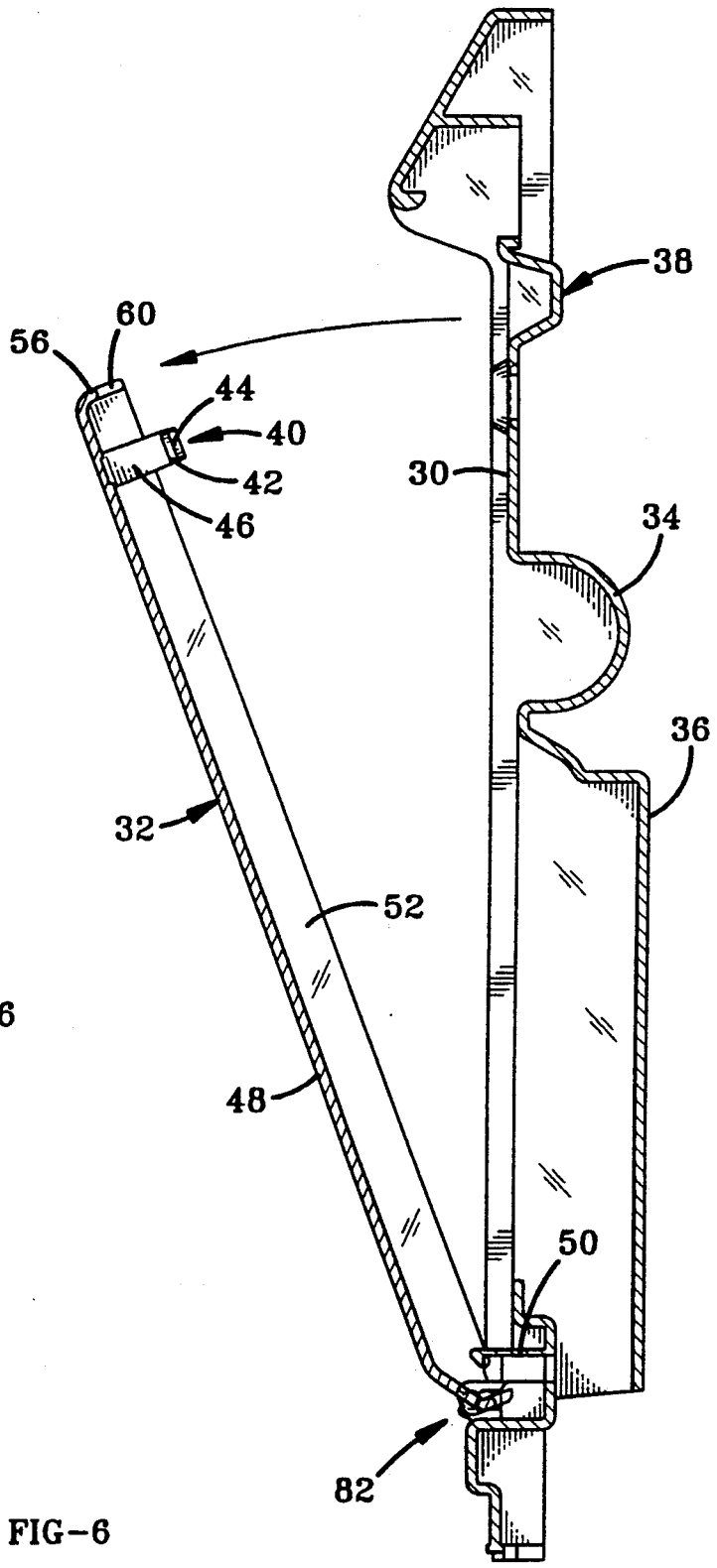
FIG. 5 is a similar view with the tool door swung partly open.

The tools are conventionally mounted in shaped depressions in well 30 such as furniture nozzle depression 34 and wall and floor brush depression 36 (FIGS. 4 and 5) with the tools held in these depressions by conventional, spaced plastic spring fingers (not shown) which compressingly grasp cylindrical portions of the tools. A wall 38 forming these depressions and the inward side of well 30 is an integral continuation of front 22 of hard bag upper portion 14.

Tool door 32 includes at its upper end and medially disposed an integral latch means 40 formed by a pair of integral latch members 42, 42 each having a catch 44 at its end and a deformable arm 46 extending to and attached to a back side of front wall 48 of tool door 32. Each of the opposed latch members 42, 42 then take the general shape of a bottom latch member 50 used as the cammable stop for limiting the tool door 32 swinging to open position.

The tool door 32 also includes vertical side walls 52, 54 that extend the total height of the front wall 48 of door 32 and a top wall 56 and bottom wall 58 which extend along the total horizontal width of the top and bottom sides of front wall 48. Top wall 56 and front wall 48 are rounded at their juncture as are the vertical side walls 52 and 54 with their juncture with front wall 48 (not shown) while the bottom wall 58 is chamfered at its junction with front wall 48. These smooth junctures provide a pleasing aesthetic effect to the tool door 32. The front wall 48 may also be slightly bowed from side to side from the top extent of the tool door 32 to its bottom extent to add to this pleasing effect. Top wall 56 may be made discontinuous at its middle to provide an opening 60 in it for a finger hold for easy operator manipulation of the tool door 32.

The tool door 32 is hingedly attached to the hard housing upper portion 14 near its bottom termination by a pair of integral pivot pins 62, 62 extending parallel to bottom wall 58 but set slightly upwardly therefrom, each substantially centered in a pivot pin notch 64 extending both through the front wall 48 and bottom wall 58 so that there is a clearance space in tool door 32 both above and below the pivot pins 62, 62 for the reception of their corresponding hinge parts.

These pivot pins are each received in an open U shaped portion 66 (FIGS. 6–10) formed by two outwardly extending short arms 68, 70 which are turned inwardly towards each other at their outer ends. This forms a pivot hinge 72 for lodgement of a pivot pin 62. By this arrangement, the tool door 32 can be seen as hingedly swinging from the hard housing upper portion 14.

The tool door 32 includes a medially disposed bottom latching tab or ledge 74 which extends inwardly from and is aligned with an inner portion 76 of bottom wall 58. This provides the catch for latch 50 which is integral with and extends outwardly from hard housing upper portion 14. Latch 50 includes a nose 78 and a hook 80 to be essentially formed in a conventional latch shape with the hook 80 situated for engagement by the latch 74. The latch 50 is plastic and generally deformable so that it, acting against latching tab or ledge 74, forms an override deformable stop for the tool door 32 when swung to its open position.

This function of tool door 32 is clearly portrayed in these same FIGS. 6–10.

Figure 6:
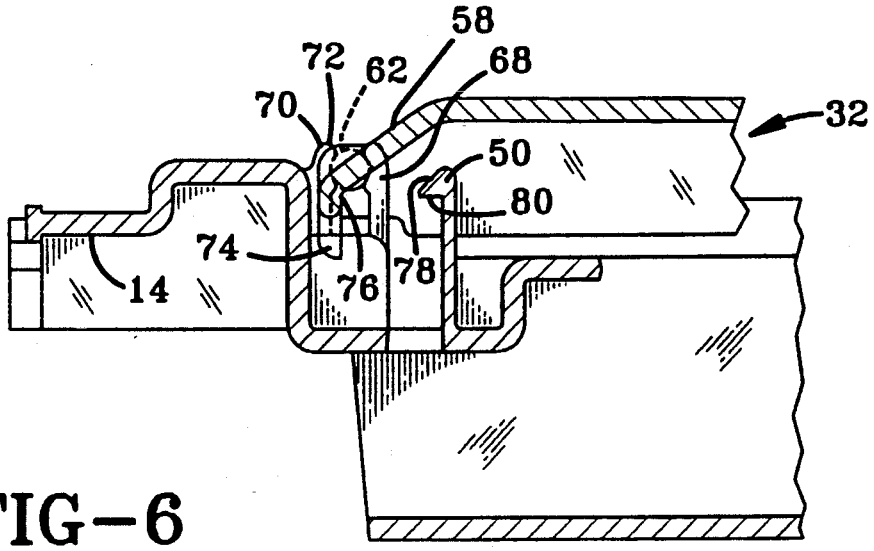
FIG. 6 is a detailed view of the tool door hinge arrangement and cammable stop latch taken generally as indicated in FIG. 4 and showing the tool door closed.

In FIG. 6 the tool door 32 is shown in closed position with each of its hinge pivot pins 62 disposed within its pivot hinge 72. The door is latched closed in this position as shown, e.g., in FIG. 4 covering the tool well 30 and its mounted tools.

Figure 7:
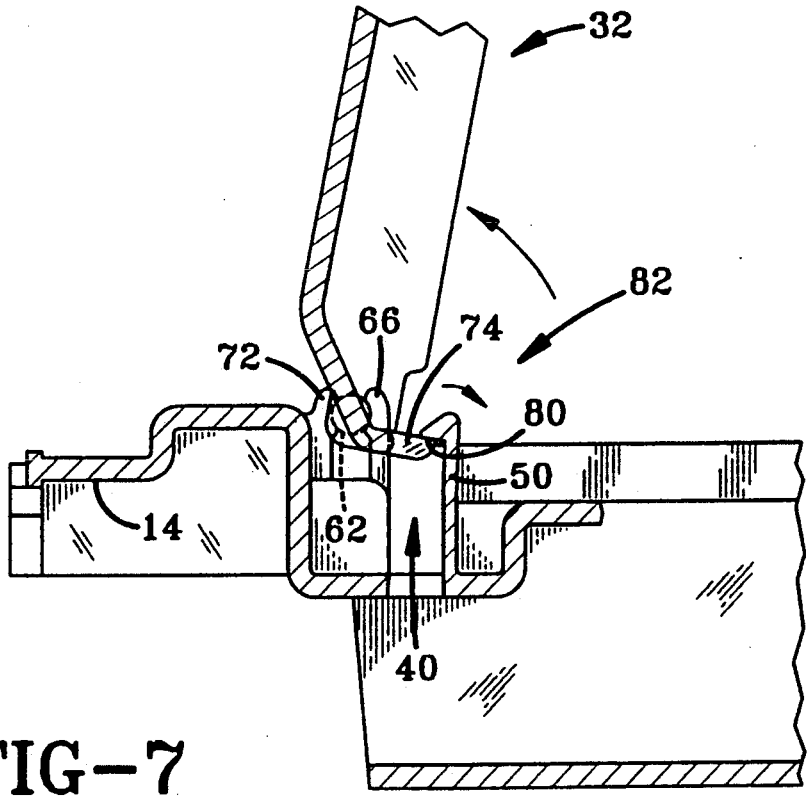
FIG. 7 is a similar view showing the tool door swung to its stop position prior to camming override of it.

In FIG. 7, the tool door 32 has hinged counterclockwise, in the view afforded, from that of FIG. 6 as shown by the long arrow so that the tool door 32 is open for operator selection of a desired tool. To limit this swing, tab 74 on the bottom side 58 of tool door 32 has abutting engaged latch 50 through its hook 80 to provide a positive stop for the tool door 32. This may be overcome with additional operator effort by swinging the tool door 32 further counterclockwise (in the direction of the long arrow) to cammingly cause the latch 50 to rotate clockwise in this view (short arrow) to permit the tool door 32 to swing further downwardly as its tab 74 clears from latch hook 80.

Figure 8:
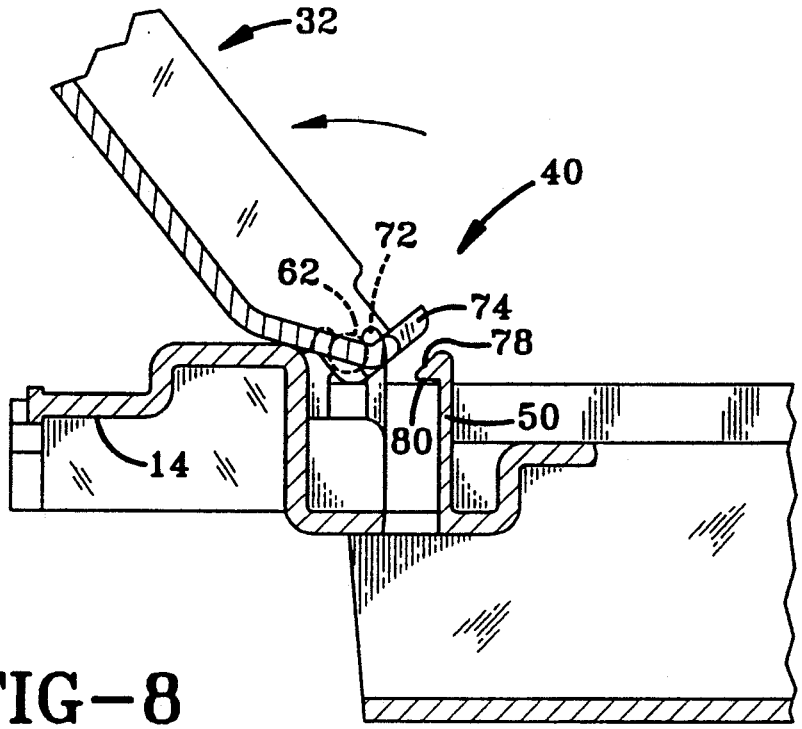
FIG. 8 is a similar view showing tool door swung past its stop position after camming the cammable stop latch for release.

In FIG. 8, the tool door 32 is shown swung past engagement of latch 50 with ledge or tab 74 to place these two elements in a non-abutting, non-interfering relationship while the pivot pin 62 of tool door 32 is still engaged with the pivot hinge.

Figure 9:
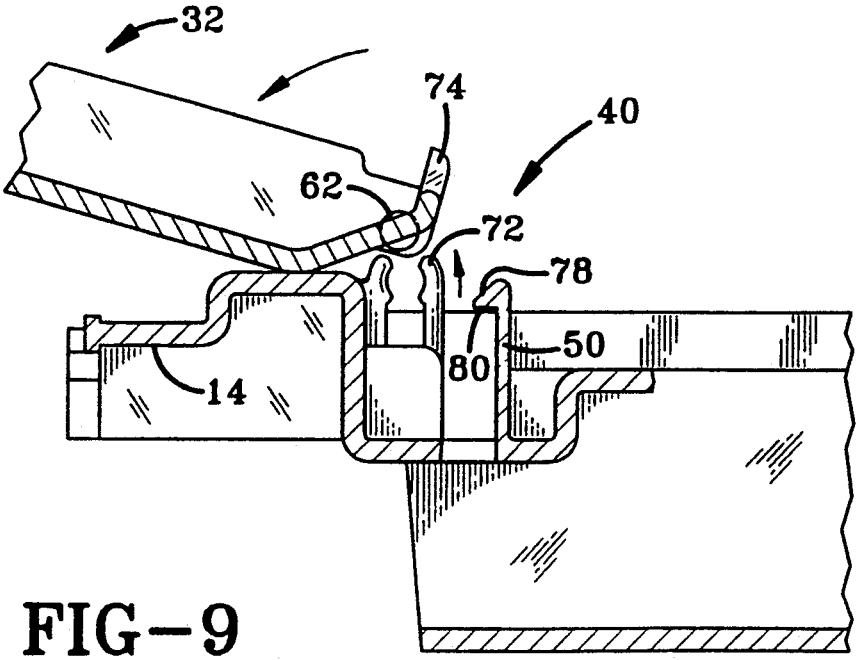
FIG. 9 is a similar view but showing the tool door released from the hard housing upon further swinging movement.

In FIG. 9 the tool door 32 is shown as it has been swung further downwardly to a completely released or break-away position. This release is occasioned by each of the tool door pivot pins 62 essentially walking out of the pivot hinges 72 by the pivot pins camming against the inside of the lower arm 70 and forcibly springing past the upper arm 68. The tool door 32 is then completely removed from the upright cleaner 10 so that a breakaway feature is provided for this door through the cooperation of the latch 50, pivot pins 62, 62 and pivot hinges 72, 72.

Figure 10:
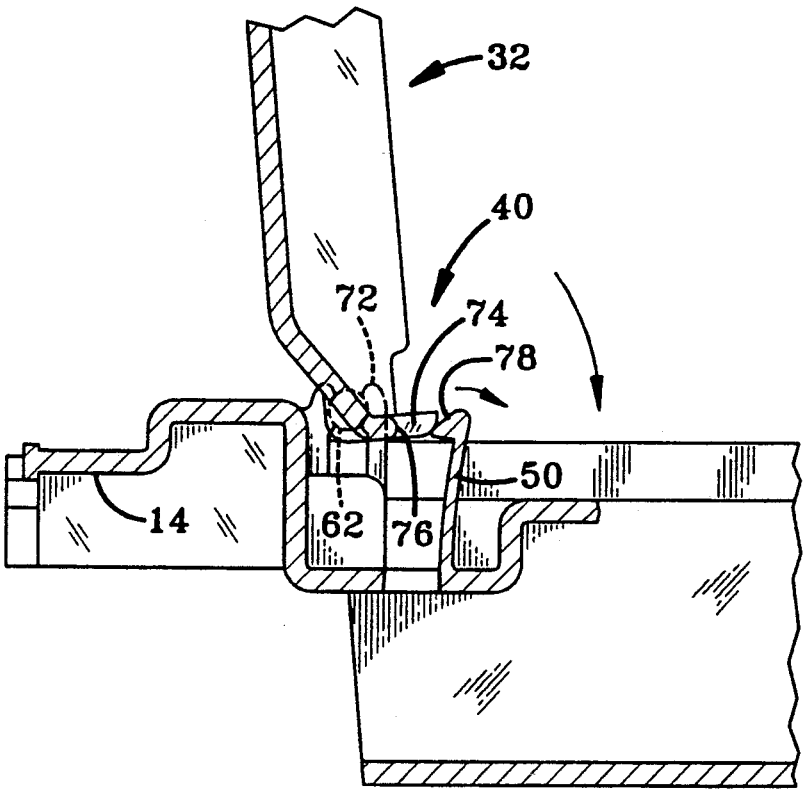
FIG. 10 is a similar view but showing the tool door pintles reinserted in their clevises and the tool door camming the cammable stop latch during its upward swinging movement.

FIG. 10 illustrates the remounting of the tool door 32. It is shown as rotated to be positioned, with the pivot pins 62, 62 in an inserted position within the hinge pivots 72, 72, with the tab 74 downwardly or outwardly of the latch 50 but engaged with it. This engagement of the latching tab 74 with the nose 78 of the latch 50 as the tool door 32 swings clockwise upwardly (long arrow) cams the latch 50 also clockwise (short arrow) until the tab 74 clears the latch 50 and takes a position inwardly or behind it. The latch 50 springly moving back to its original and undeformed state at this time. This relative position of tool door 32 and its latch 50 and latching tab 74 can be seen by again viewing FIG. 7. It should now be obvious that both assembly and disassembly of the tool door 32 from the hard housing upper portion 14 is occasioned by upward or downward swinging of this tool door and a camming engagement and disengagement of its latch means 82 formed by latch 50 and latch tab 74.

It should be clear that the structure described fully meets all the objects set out for it in this application and, that, there could be many changes made to it which would still fall within its spirit and purview. For example, the releasable hinges of this structure could be utilized alone but there would be a tendency for the tool door to collide with the hood before separation of the tool door occurred. Also, the cammable stop of this structure could be utilized with non releasable hinges and it would still serve somewhat as a stress protector for the tool door and its hinges and stop.

What is claimed is:

1. An upright cleaner having a tool storage arrangement including:

a) a hard housing portion pivoted to a suction nozzle and extending upwardly therefrom;

b) a tool storage well disposed in said hard housing portion;

c) a tool door extending vertically to cover said tool storage well and hingedly pivoted to said hard housing portion;

d) said tool door downwardly pivoting for uncovering said tool storage well to abut an overridable deformable stop and, upon further forced downward pivoting, to override said stop and, upon further swinging, to selectively break-away for release of it from said hard housing portion;

e) said hinged pivoting provided by open, spaced hinge pivot members forming open slots on one of said door and said housing;

f) hinge pivot pins on the other of said door and said housing and disposed in said open slots to permit pivoting removal of said door;

g) said overridable deformable stop mounted on one of said tool door and said hard housing portion removed from and independent of said spaced hinge pivot members to provide an overridable limit overridden by said further forced swinging movement of said tool door;

h) said stop, upon being overridden, cammingly permitting said tool door to pivot further downwardly for its eventual break-away release from said hard housing portion;

i) said spaced hinge pivot members having opposed curvilinear open ends to form a pivot point for hinging of said pivot pins for swinging of said doors; and j) at least some of said curvilinear open ends of said spaced hinge pivot members being acted against by said pivot pins during break-away swinging of said door to cam said door away from said hinge pivot members for break-away final release of said door from said hard housing portion after said further forced swinging of said door over said overridable stop.

* * * * *